US005240125A

United States Patent [19]

Kunz

[11] Patent Number: 5,240,125

[45] Date of Patent: Aug. 31, 1993

[54] POINT OF SALE PUSHER DEVICE

[75] Inventor: Steven A. Kunz, Pfafftown, N.C.

[73] Assignee: Decision Point Marketing, Inc., Winston-Salem, N.C.

[21] Appl. No.: 883,161

[22] Filed: May 15, 1992

[51] Int. Cl.[5] ..... A47F 5/00

[52] U.S. Cl. ..... 211/59.3; 211/74; 312/71

[58] Field of Search ..... 211/59.2, 59.3, 74; 312/45, 71, 72

[56] References Cited

U.S. PATENT DOCUMENTS

| | | | |
|---|---|---|---|
| 2,954,129 | 9/1960 | Gordon | 211/59.3 |
| 3,357,597 | 12/1967 | Groff . | |
| 3,780,873 | 12/1973 | Silva | 211/59.3 |
| 3,848,745 | 11/1974 | Smith . | |
| 4,269,326 | 5/1981 | Delbrouck | 312/71 X |
| 4,351,439 | 9/1982 | Taylor | 211/59.3 |
| 4,730,741 | 3/1988 | Jackle et al. | 312/71 X |
| 4,732,282 | 3/1988 | Lockwood | 312/45 X |
| 4,785,943 | 11/1988 | Deffner et al. | 211/59.2 |
| 4,898,282 | 2/1990 | Hawkinson et al. | 211/59.3 X |
| 4,907,707 | 3/1990 | Crum . | |
| 5,012,936 | 5/1991 | Crum . | |
| 5,027,957 | 7/1991 | Skalski . | |
| 5,131,563 | 7/1992 | Yablans | 312/71 X |

*Primary Examiner*—Robert W. Gibson, Jr.
*Attorney, Agent, or Firm*—Rhodes, Coats and Bennett

[57] ABSTRACT

An apparatus for displaying goods packaged in glass containers on a shelf along the "glass aisle" of a grocery store is disclosed. Included is a bracket having two outwardly extending flanges positionable in a card channel on the front of a store shelf, outwardly extending mounts and a fascia mounted thereto, the fascia including a surface adapted to receive a label appropriate for the goods displayed, a stop to prevent containers from being pushed off the shelf, and opposed holes. Elongated rails extend rearward of the bracket and include outwardly extending forward terminations to permit the rails to be pinched together for alignment with and insertion into the holes in the bracket to join the bracket and rails, facilitating selective detachment of the rails from the bracket, an inner, lower pair of rails on which the containers may be supported, a first outer, upper pair for engaging the sides of the containers, and a second upper pair of rails to restrain tipping of the glass containers. A pusher is adapted to ride on the rails and has channels through which the outer rails extend with a face towards the bracket which conforms to the glass containers' shape. A variable rate tempered spring extends rearward of the bracket to drive the pusher towards the bracket so that the amount of force driving the pusher toward the bracket decreases as the pusher gets closer to the bracket. Thus, the bracket can be engaged on a store shelf with the rails extending toward the rear of the shelf so that the pusher can move forwardly and rearwardly along the rails with the spring member driving the pusher towards the front of the shelf, permitting goods packaged in glass containers to be located by the rails so that the pusher continually advances the glass containers toward the front of the shelf as forward ones of the glass containers are removed.

24 Claims, 2 Drawing Sheets

POINT OF SALE PUSHER DEVICE

BACKGROUND OF THE INVENTION

The present invention relates to improvements in store point of purchase displays, particularly of the "pusher" type.

It is well known in merchandising products to use "pusher" type product displays to keep products neatly arrayed on a shelf and easily accessible to customers. Examples of point of sale displays of this sort can be seen in U.S. Pat. No. 3,357,597 to Groff, disclosing a dispenser in which boxes of cigarettes and cigars are passed to the front of the display. Similarly, U.S. Pat. No. 4,907,707 to Crum includes a pusher assembly for packaged meats to keep them at the front of the display.

The Crum and Groff patents are exemplary of prior displays in which rectangularly shaped, unbreakable packages are displayed in a pusher type display. This has been known to work well for packages having these characteristics.

However, for other types of goods, pushers of this sort have not been adopted. In particular, grocery stores have a particular portion of the store known as the "glass aisle" in which products traditionally packaged in glass jars and bottles are commonly displayed. These includes salad dressings, ketchup, mayonnaise, pickles, relishes and the like. These product packages tend to be made of glass, with a screw-on top. As a result, the container is breakable. Those of ordinary skill in the retail merchandising area have not heretofore seen it possible to merchandise such products in a pusher point of sale display. The denseness of the packaged product requires a strong pushing force to cause them to move, the resulting inertia causes them to continue to move once started, and their fragility suggests that the risk of pushing them off the shelf and causing breakage is too great to permit that type of display of such a product.

Nonetheless, various advantages are known which would accrue if a pusher type package could be used with such goods.

As Crum points out, rotation of stock is highly desirable, so that as shelves are being restocked, the older, existing inventory is located at the front of the shelf, with the newer fresher goods being located behind. Thus, when a customer takes the product off of the front of the shelf, the older products are being consumed, so that the products on the shelf do not become stale or out of date. Crum also points out that it's important for the products to have the product label facing the customer and a pusher type display can yield that benefit. Finally, as Crum points out, pusher type displays can keep the product organized on the shelf in a regular and attractive fashion. However, with Crum and the other pusher devices of the prior art do not provide is a way to obtain all of these advantages for the "glass aisle," so this need continues in the art.

SUMMARY OF THE INVENTION

The present invention fulfills this need in the art by providing an apparatus for displaying goods packaged in glass containers on a store shelf. The apparatus includes a bracket for engaging the front of the shelf, elongated rails extending rearward of the bracket, a spring member extending rearward of the bracket, and a pusher adapted to ride on the rails driven by the spring member towards the bracket. The bracket can be engaged on a store shelf with the rails extending toward the rear of the shelf so that the pusher can move forwardly and rearwardly along the rails, with the spring member driving the pusher towards the front of the shelf. Goods packaged in glass containers may be located by the rails so that the pusher continually advances the glass containers toward the front of the shelf as forward ones of the glass containers are removed.

In one embodiment the bracket has two outwardly extending flanges positionable in a card channel on the front of a store shelf. The bracket may include a stop to prevent containers from being pushed off the shelf. In a preferred embodiment the bracket includes opposed holes, and the rails include outwardly extending forward terminations to permit the rails to be pinched together for alignment and insertion into the holes to join the bracket and rails. This permits the rails to be selectively detachable from the bracket.

Preferably the bracket includes outwardly extending mounts and a fascia is mounted thereto, the fascia including a surface adapted to receive a label appropriate for the goods displayed.

In a preferred embodiment, the rails include an inner, lower pair on which the containers may be supported and an outer, upper pair for engaging the sides of the containers. In one embodiment the inner, lower pair of rails are encased in a silicone-impregnated material to reduce sliding friction of containers therealong. In some instances, it is desirable to include a top pair of rails to restrain tipping of the glass containers. The top pair may include a deflection, which adds to their rigidity. Preferably the rails are formed of coated wire.

In a preferred embodiment the pusher has channels through which the outer rails extend. The channels may be provided with roller bearings to reduce the friction between the channels and the outer rails. Alternatively, the channels may be provided with lubricated or other low friction bearings to reduce the friction between the channels and the outer rails.

The spring member is preferably a variable rate tempered spring so that the amount of force driving the pusher toward the bracket decreases as the pusher gets closer to the bracket.

In one embodiment the pusher has a face towards the bracket which conforms to the glass containers' shape.

The invention also provides a method of maintaining an inventory of goods packaged in glass containers having a container front on a store shelf along a store aisle in attractive and merchandisable condition. The method includes securing a point of purchase display to the shelf with a bracket having rearwardly extending rails and a driven pusher movable on the rails toward the bracket, loading glass containers on the rails to locate the fronts of the glass containers so that they face toward the aisle and to push the pusher toward the rear of the shelf, and permitting glass containers to be continually advanced toward the front of the store shelf as forward ones of the glass containers are removed.

The method may proceed by maintaining the inventory in proper rotation. This is accomplished by removing an old inventory of glass containers from the display, loading a new inventory of the glass containers on the rails to locate the fronts of the glass containers so that they face toward the aisle and to push the pusher toward the rear of the shelf, and subsequently reloading the old inventory of glass containers on the rails, so that the old inventory is forward of and therefore consumed before the new inventory.

The invention further provides a method of displaying goods packaged in glass containers on a store shelf including securing to the store shelf a bracket having rearwardly extending rails and a pusher movable on the rails and driven toward the bracket by a spring so that the pusher can move forwardly and rearwardly along the rails with the spring member driving the pusher towards the front of the shelf. The method proceeds by loading glass containers on the rails to push the pusher toward the rear of the shelf and permitting glass containers to be continually advanced toward the front of the store shelf as forward ones of the glass containers are removed.

The method may include the preliminary step of assembling the rails to the bracket by pinching the rails together and inserting them into opposed holes on the bracket. It may also include the preliminary step of mounting the pusher on outer ones of the rails. Also contemplated is the preliminary step of mounting a fascia having a label appropriate for the goods in the glass containers on the bracket.

The loading step may include locating the base of the glass container against a previously positioned glass container, pressing the previously positioned glass container rearwardly against the force of the spring member and inserting the top of the glass container under a forwardly extending loop on the rail.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
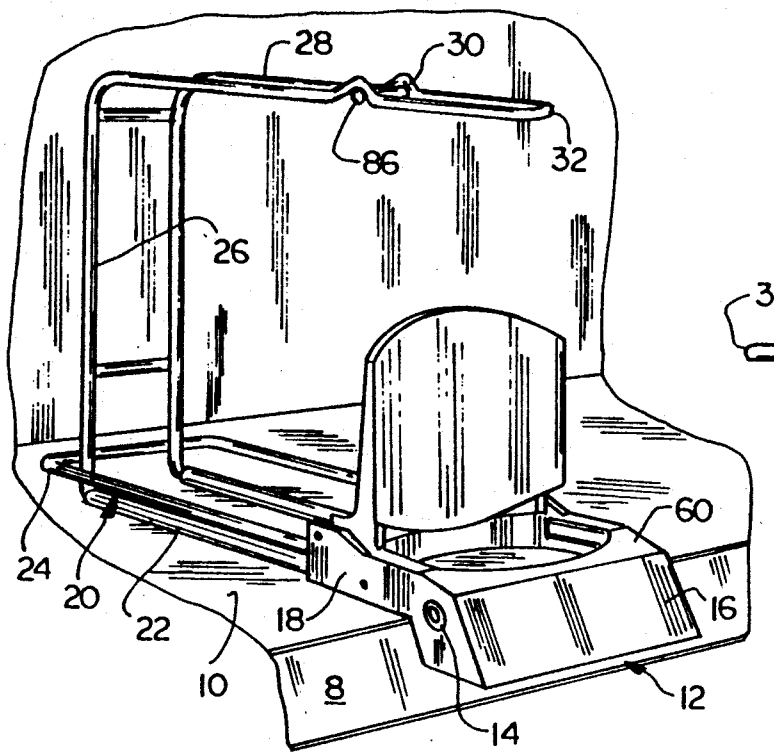
FIG. 1 is a perspective view of the apparatus according to an embodiment of the invention.

A perspective view of a pusher display of the present invention as mounted on a store shelf 10 can be seen in FIG. 1. The display 12 includes a bracket component 14, a fascia 16, and pusher 18 and a wire rail assembly 20. Generally speaking, the bracket 14 affixes to a card channel 8 on the front of the shelf 10. The bracket 14 can be seen better in FIG. 3 and will be described more fully hereinafter. The bracket has mounted to it the fascia 16 and the wire rack 20, with the pusher 18 being mounted on the wire rack 20, all as will be more fully described hereinafter.

The wire rack 20 includes lower rails 22 and upper, outer rails 24 made of a wire coated with a low-friction coating. The lower rails 22 have mounted on them a silicone-impregnated rubber to provide a low-friction surface on which the containers to be displayed are readily movable. Upper rails 24 provide lateral support for the containers to prevent them from moving to the side under the influence of the forces to be applied to them. An upper run 26 of wire supports the forwardly extending top rails 28. Top rails 28 have deflection portions 30 therein provided to enhance the rigidity of the top rail 28. In addition, the deflection 30 also permits bottles to be inserted into the rail assembly rearward of the forward-most bottle. Also the spacing of the top rail 28 may be such as to prevent competitive products from being loaded in the display 12. The forward end of the top rail 28 terminates in a closed loop 32 to provide forward containment of the upper portions of bottles loaded into the display 12.

Figure 3:
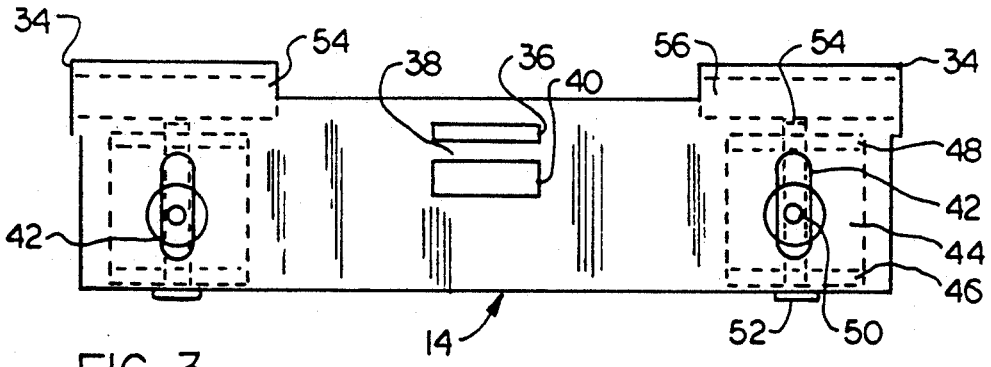
FIG. 3 is an elevation view of the bracket component of the embodiment of FIG. 1.

Referring now to FIG. 3, the bracket 14 can be seen in greater detail. Bracket 14 has affixed to it two U-shaped metal clamping members 44. The lower edges of the side members of clamping member 44 terminate in outwardly turned flanges 46,48. The side members of the clamp 44 are inter-engaged through threaded holes by a bolt 52 having a threaded shank 54. Rotation of the bolt 52 in one direction pushes the edges 46,48 apart while rotation in the other direction draws them together. Preferably, the bolt 52 has a tamper-proof head. The clamp 44 is affixed to the bracket 14 by a rivet 50 passing through an adjustable opening 42. One such clamp 44 is provided on either end of the bracket 14.

Bracket 14 has two elongated holes 36,40 aligned midway between the clamps 44, resulting in a bridging portion 38. The bridging portion 38 is provided as an anchoring point for the spring tension member extending rearwardly of the bracket 14, seen in FIG. 2.

The bracket 14 has two bosses 34 extending outwardly of the ends of the bracket 14. Inward of the bosses 34 are sockets 55,56 provided to receive outwardly turned portions of the lower rails 22.

The bosses 34 are provided for the mounting of the fascia 16. Since the fascia 16 is made of a somewhat flexible injection molded plastic, it may be easily mounted onto the bosses 34. Preferred plastics for the fascia, pusher and bracket are injection-molded high impact polystyrene.

Referring again to FIG. 1, the fascia 16 includes a forwardly facing label surface, to which any desired label can be affixed, such as by pressure-sensitive adhesive or the like. Alternatively, the front face of the fascia 16 may be provided of a card channel configuration, much like the card channel 8 of the conventional store shelf, so that card labels may be installed. The mounting of the fascia 16 on the bracket 14 assures that the orientation of the label surface will face the customer, regardless of the angle of the card channel 8 with respect to the entire shelf. It should be understood that various shelves are presently commercially available which have differing angles between the card channel and the supporting surface of the shelf, so that making the fascia 16 in this fashion accommodates its installation over a wide range of such shelves. A separate card channel may also be provided to clip onto the fascia, including a rearwardly extending lower flange which covers the screws 52 to reduce tampering. Such a separate card channel can be provided in an extended length to gang together multiple, side-by-side ones of the pusher device.

Preferably, the fascia 16 includes rearwardly extending ears 60 which conform to the shape of the containers to be displayed, although such conformance is not necessary. Desirably, the ears 60 include side portions which extend over and cover the forward portions of the upper rails 24, so they are not readily seen by the customer.

Figure 2:
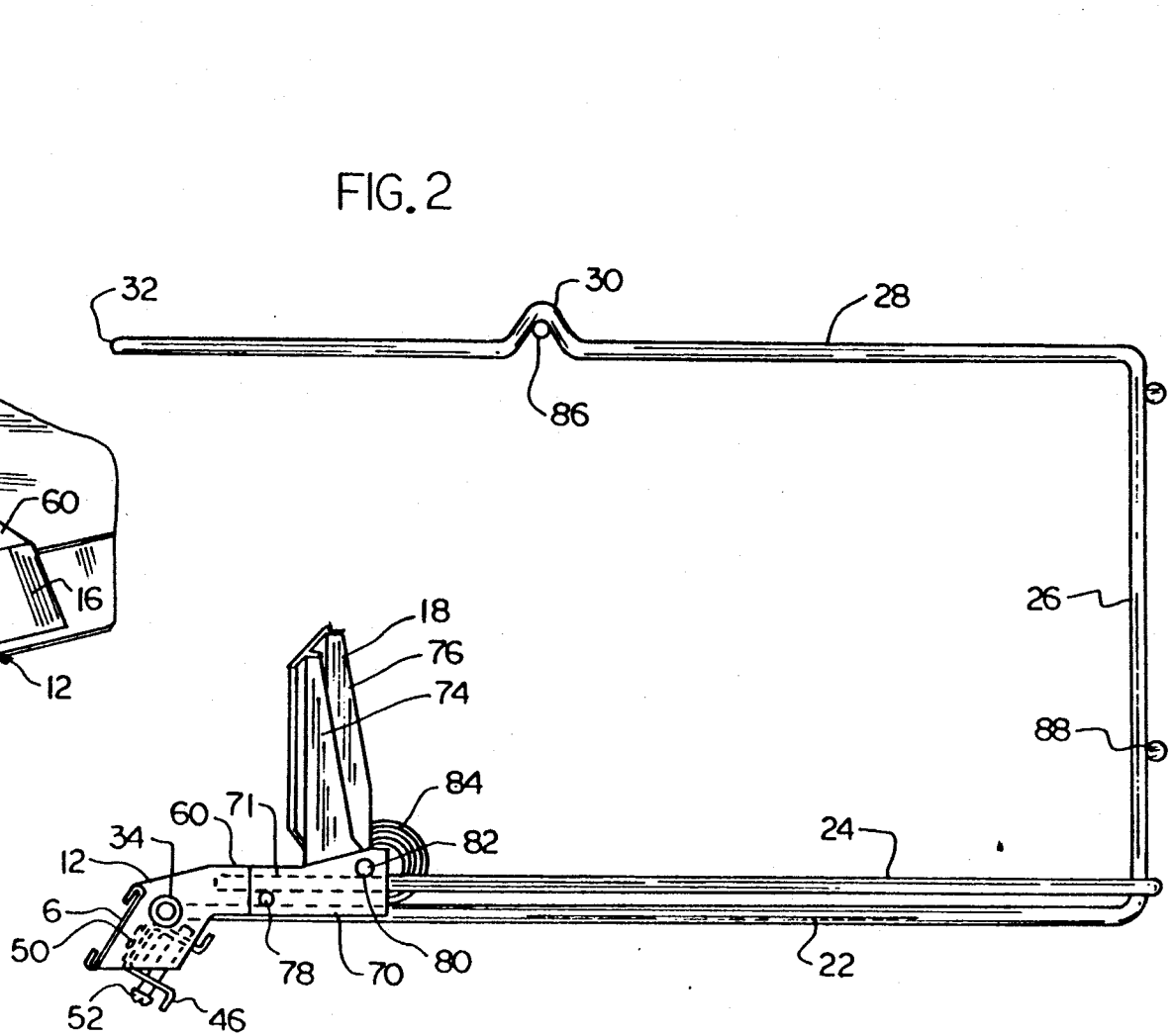
FIG. 2 is a side elevation view of the apparatus of FIG. 1 with some parts shown in phantom.
Figure 5:
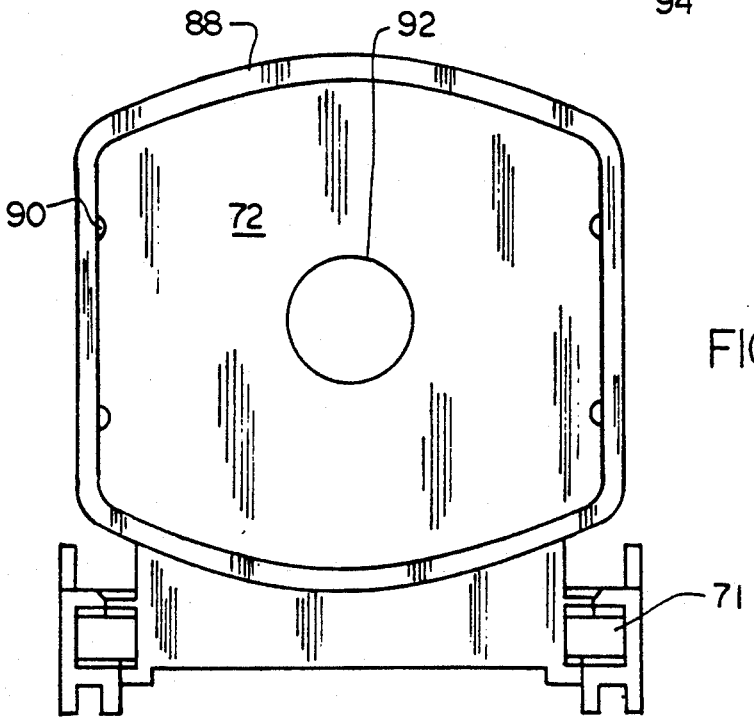
FIG. 5 is an elevation view of the front of the alternate pusher embodiment of FIG. 4.

Referring now to FIG. 2, the arrangement of the pusher 18 on the rails 24 can be seen. The pusher 18 includes a lower carriage portion 70 having a through-extending passageway 71 through which the upper, outer rail 24 extends. The upper, outer rail 24 thereby terminates underneath of the rearwardly extending ear 60 of the fascia 16. The carriage portion 70 has integrally molded with it vertical flanges 74,76. There are typically two each of flanges 74 and 76, but only one can be seen in FIG. 2, the others being obscured by flange 76. The flanges 74,76 support a pusher surface 72, desirably conformed to the shape of the product to be dispensed. However, such conformance is not absolutely necessary. In addition, various supports other then the flanges 74,76 may be substituted. As seen in FIG. 5, the pusher surface may be provided with a peripheral flange 88 having tabs 90 to permit the mounting inwardly thereof of a press-fit label. Providing a hole 92 in the surface 72 then permits a press-fit label to be pushed out and replaced as desired. Alternately, the label may be held in place with adhesive.

Figure 4:
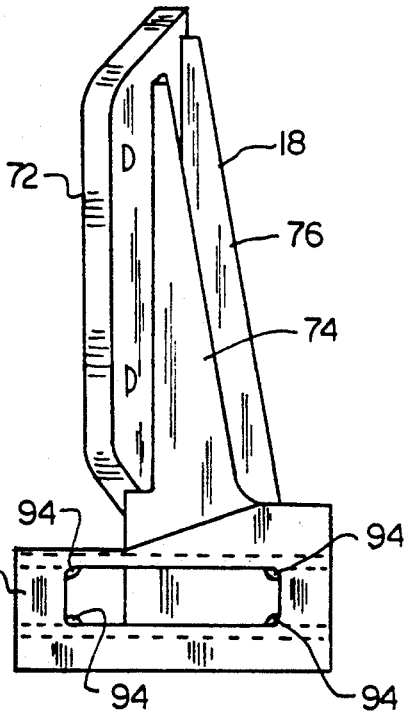
FIG. 4 is an elevation view of the side of an alternate pusher embodiment, with portions shown in phantom.

The carriage 70 and its channel 71 are provided with bearings 78,80. Various bearing embodiments can be used, two of which are shown in FIG. 2. Thus, the bearings 78, 80 may be of extruded Delron impregnated with silicone. Alternatively, the bearings may in the form of rollers riding on a shaft affixed to the carriage 70. Typically, any given bearing assembly will be made of both the same type of bearing. Another bearing arrangement seen in FIG. 4 is provided by molded bumps 94 raised from the channel 71, to reduce the contact surface area with the rail. Preferably, such bumps are also impregnated with silicone or other lubricant.

FIG. 2 also shows the coil of spring 84, a forward, outer extension of which terminates in a hook extending around the post 38 of bracket 14. The coil then extends rearwardly of the pusher 18, with its substantial diameter forcing the rear of the pusher 18 toward the left in FIG. 2. As the pusher 18 is pushed to the right, the force exerted by the spring 84 increases, a characteristic typical of variable rate tempered springs. Preferably the portion of the pusher contacted by the spring is also silicone impregnated.

One of the significant advantages of the present display is its modular construction, permitting various components to be mixed and matched as desired for a particular product display. That is, the wire rack 20 may be provided in various sizes. Thus, the rail 28 may be provided at a desired height above the rail 22, depending upon the height of the containers to be stored. In addition, the distance from the upright 26 to the looped end 32 may be varied depending upon the number of products to be displayed, which will in turn largely be determined by the depth of the shelf to which the display is to be attached. In addition, the pusher 18 may be replaced, so that its product conforming surface 72 may be selected for the product to be displayed, as well as having graphics thereon adapted for the product to be displayed. This, of course, is also a feature of the modularity of the fascia 16, with its label display surface. Thus, the various components can be mixed or matched for the desired product, shelf size, and product container shape and size.

A further modification specifically contemplated as being within the scope of the invention is to provide a multiplicity of the displays side-by-side, particularly including a multiplicity of ganged wire racks 20 joined by laterally extending bars 86,88. Ganging of adjacent displays can be enhanced by providing the fascia with a boss on one side and a recess on the other, so the boss of one fascia fits into and provides an interlock with the recess on an adjacent fascia. Preferably, these are annular, surrounding the bosses 34 of the bracket. Also, the addition of a separate, clip-on card channel (mentioned above) extending over the length of several displays adds to the structural integrity and visual consolidation of multiple side-by-side displays.

Use of the display is quite straightforward. First, installation proceeds by locating the two flanges 46,48 in the card channel 8 of a shelf. Then screw 52 is turned to drive the two flanges apart to lock them into the edges of the card channel 8. Then, the two forward ends of the lower rails 22 are pinched together, so that the outwardly extending terminations thereof are closer together than the space between the sockets 55,56. The outwardly extending terminations are then aligned with the sockets 55,56 and released to join the rail assembly 20 to the bracket 14. The forward, hooked end of the spring 84 is inserted around the post 38 of the bracket 14. Then, the spring 84 is extended rearwardly somewhat, followed by the insertion of the forward ends of the rails 24 through the passageway 71 of the pusher 18, to hold the spring 84 rearwardly of the pusher 18. Finally, the fascia 16 is clamped over the bracket 14, with the bosses 34 extending outwardly through holes in the fascia 16, with the fascia covering the forward ends of the rails 24 and in alignment with the carriage portion 70 of the pusher 18.

At this point, the graphics on the front portion 72 of the pusher 18 and on the label surface of the fascia 16 may be modified, as desired. Alternatively, these components can be pre-labeled.

The assembly steps need not follow the order just recited. Also, various of the assembly steps can precede the clamping of the bracket to the card channel 8.

Loading of the display with containers proceeds in a straightforward manner. First, the bottom of the container is inserted between the fascia and the lower portion of the pusher surface 72, forcing the pusher 18 rearwardly against the compression force of the spring 84, with the top of the product tilting forwardly. When the bottom is in place, the top can be passed under the loop 32 of the top rail 28 to hold the top portion of the container in position. Then, a second container may be loaded in similar fashion, pushing against the in-place container which, in turn, pushes the pusher and spring rearwardly, until the top of the second container clears the loop 32. This may continue in like fashion until the display is loaded. It will be appreciated that, as the products are being loaded, the pusher 18 is subject to a counterclockwise rotational force (in the view of FIG. 2) about its affixation to the rail 24. This may have a tendency to cause a pinching and thereby inhibit movement of the pusher. Thus, providing the bearings 78,80 of low friction reduces the tendency of the pusher to bind under these circumstances. Actually, during forward pushing of the containers when a forward-most container is removed; the bearings 78,80 are of little consequence.

When a customer selects the product displayed in the display, he or she merely lifts it straight up, clearing the bottom from the fascia 16, so that the top can then be pulled down, free of the loop 32. Then, the spring 84 will compress, pushing the pusher 18 toward the fascia 16 and presenting the next product for the next customer in the same position as the earlier selected product.

The invention aids in stock rotation by assuring that the products are always at the front of the shelf, so that when restocking is to be carried out, the old stock is immediately available to the stock person, easy to remove. Then, upon removal, the new stock can be put in place, followed by replacement of the old stock.

The invention aids in merchandising since the customer is always present with product immediately available at the front of the shelf, rather than requiring reaching to the back of the shelf. The invention also prevents losing a sale because existing product is hidden behind an adjacent line of another product.

Also, the invention assists in encouraging sales, since the customer is always presented with an orderly display of the product available for purchase. In the event that the display is sold out, an indication of same to the customer, along with information that the store, in fact, typically carries that product, is available, by virtue of the labeling on the front face 72 of pusher 18, which will be visible to the customer when the last product is removed. Also, once the product is taken from the shelf, although it is replaceable on the shelf, the customer will have a tendency to put it in his or her shopping cart, since the void on the shelf from whence the product has been removed will have been filled.

While the invention has been described in connection with the sale of products in glass containers, such term should be broadly construed to include not only glass, but also plastic. In fact, the term should be construed to include as equivalents bottles and jars generally, regardless of material, shape or the product inside.

What is claimed is:

1. An apparatus for displaying goods packaged in glass containers on a store shelf comprising a bracket for engaging the front of the shelf, elongated rails above and extending rearward of said bracket, a spring member extending rearward of said bracket, and a pusher adapted to ride on said rails driven by said spring member towards said bracket, whereby said bracket can be engaged on a store shelf with said rails extending toward the rear of the shelf so that said pusher can move forwardly and rearwardly along said rails with said spring member driving said pusher towards the front of the shelf, permitting goods packaged in glass containers to be located by said rails so that said pusher continually advances the glass containers toward the front of the shelf as forward ones of the glass containers are removed.

2. An apparatus as claimed in claim 1 wherein said bracket has two outwardly extending flanges positionable in a card channel on the front of a store shelf.

3. An apparatus as claimed in claim 1 wherein said bracket includes a stop to prevent containers from being pushed off the shelf.

4. An apparatus as claimed in claim 1 wherein said bracket includes opposed holes and said rails include outwardly extending forward terminations to permit said rails to be pinched together to for alignment with and insertion into said holes to join said bracket and rails.

5. An apparatus as claimed in claim 1 wherein said bracket includes outwardly extending mounts and a fascia mounted thereto, said fascia including a surface adapted to receive a label appropriate for the goods displayed.

6. An apparatus as claimed in claim 1 wherein said rails are selectively detachable from said bracket.

7. An apparatus as claimed in claim 1 wherein said rails include an inner, lower pair on which the containers may be supported and an outer, upper pair for engaging the sides of the containers.

8. An apparatus as claimed in claim 7 wherein said inner, lower pair of rails are encased in a silicone-impregnated material to reduce sliding friction of containers therealong.

9. An apparatus as claimed in claim 8 wherein said pusher has channels through which said outer rails extend.

10. An apparatus as claimed in claim 9 wherein said channels are provided with roller bearings to reduce the friction between said channels and said outer rails.

11. An apparatus as claimed in claim 9 wherein said channels are provided with lubricated bearings to reduce the friction between said channels and said outer rails.

12. An apparatus as claimed in claim 1 wherein said rails include a top pair of rails to restrain tipping of the glass containers.

13. An apparatus as claimed in claim 12 wherein said top rails include an upper deflection portion.

14. An apparatus as claimed in claim 1 wherein said rails are formed of coated wire.

15. An apparatus as claimed in claim 1 wherein said spring member is a variable rate tempered spring so that the amount of force driving said pusher toward said bracket decreases as said pusher gets closer to said bracket.

16. An apparatus as claimed in claim 1 wherein said pusher has a face towards said bracket which conforms to the glass containers' shape.

17. An apparatus for displaying goods packaged in glass containers on a store shelf having a card channel on its front comprising:

a) a bracket having:

1) two outwardly extending flanges positionable in the card channel on the front of a store shelf, 2) outwardly extending mounts and a fascia mounted thereto, said fascia including a surface adapted to receive a label appropriate for the goods displayed, 3) a stop to prevent containers from being pushed off the shelf, and 4) opposed holes, b) elongated rails extending rearward of said bracket and including:

1) outwardly extending forward terminations to permit said rails to be pinched together for alignment with and insertion into said holes in said bracket to join said bracket and rails, facilitating selective detachment of said rails from said bracket, 2) an inner, lower pair of rails on which the containers may be supported, 3) a first outer, upper pair for engaging the sides of the containers, and 4) a top pair of rails to restrain tipping of the glass containers, c) a pusher adapted to ride on said rails and having channels through which said outer rails extend with a face towards said bracket which conforms to the glass containers' shape, and d) a variable rate tempered spring extending rearward of said bracket to drive said pusher towards said bracket so that the amount of force driving said pusher toward said bracket decreases as said pusher gets closer to said bracket, whereby said bracket can be engaged on a store shelf with said rails extending toward the rear of the shelf so that said pusher can move forwardly and rearwardly along said rails with said spring member driving said pusher towards the front of the shelf, permitting goods packaged in glass containers to be located by said rails so that said pusher continually advances the glass containers toward the front of the shelf as forward ones of the glass containers are removed.

18. A method of maintaining an inventory of goods packaged in glass containers having a container front on a store shelf along a store aisle in attractive and merchandisable condition comprising securing to the shelf a point of purchase display including a bracket having rearwardly extending rails on the top of the shelf and a driven pusher movable on the rails toward the bracket, loading glass containers on the rails to locate the fronts of the glass containers so that they face toward the aisle and to push the pusher toward the rear of the shelf, and permitting glass containers to be continually advanced toward the front of the store shelf as forward ones of the glass containers are removed.

19. A method as claimed in claim 18 further comprising maintaining the inventory in proper rotation by removing an old inventory of glass containers from the display, loading a new inventory of the glass containers on the rails to locate the fronts of the glass containers so that they face toward the aisle and to push the pusher toward the rear of the shelf, and subsequently reloading the old inventory of glass containers on the rails, so that the old inventory is forward of and therefore consumed before the new inventory.

20. A method of displaying goods packaged in glass containers on a store shelf comprising securing to the store shelf a bracket having rearwardly extending rails on top of the shelf and a pusher movable on the rails and driven toward the bracket by a spring so that the pusher can move forwardly and rearwardly along the rails with the spring member driving the pusher towards the front of the shelf, loading glass containers on the rails to push the pusher toward the rear of the shelf, and permitting glass containers to be continually advanced toward the front of the store shelf as forward ones of the glass containers are removed.

21. A method as claimed in claim 20 including the preliminary step of assembling the rails to the bracket by pinching the rails together and inserting them into opposed holes on the bracket.

22. A method as claimed in claim 20 including the preliminary step of mounting the pusher on outer ones of the rails.

23. A method as claimed in claim 20 including the preliminary step of mounting a fascia having a label appropriate for the goods in the glass containers on the bracket.

24. A method as claimed in claim 20 wherein said loading step includes locating the base of the glass container against a previously positioned glass container, pressing the previously positioned glass container rearwardly against the force of the spring member and inserting the top of the glass container under a forwardly extending loop on the rail.

* * * * *